US010463950B2

(12) United States Patent
Gomez et al.

(10) Patent No.: US 10,463,950 B2
(45) Date of Patent: Nov. 5, 2019

(54) USER MODIFIABLE PINBALL MACHINE

(71) Applicant: STERN PINBALL, INC., Elk Grove Village, IL (US)

(72) Inventors: George A. Gomez, Chicago, IL (US); Gary Stern, Chicago, IL (US)

(73) Assignee: STERN PINBALL, INC., Elk Grove Village, IL (US)

( * ) Notice: Subject to any disclaimer, the term of this patent is extended or adjusted under 35 U.S.C. 154(b) by 46 days.

(21) Appl. No.: 15/918,564

(22) Filed: Mar. 12, 2018

(65) Prior Publication Data

US 2019/0275416 A1 Sep. 12, 2019

(51) Int. Cl.
*A63F 7/02* (2006.01)
*A63F 9/24* (2006.01)

(52) U.S. Cl.
CPC ..... *A63F 7/027* (2013.01); *A63F 2009/247* (2013.01); *A63F 2009/2491* (2013.01)

(58) Field of Classification Search
None
See application file for complete search history.

(56) References Cited

U.S. PATENT DOCUMENTS

| | | | | |
|---|---|---|---|---|
| 5,338,031 | A | 8/1994 | Patla, Sr. et al. | |
| 6,096,962 | A * | 8/2000 | Crowley | G10H 1/0025 84/611 |
| 6,158,737 | A | 12/2000 | Cornell et al. | |
| 6,264,555 | B1 * | 7/2001 | Glazman | A63F 7/027 463/1 |
| 7,789,748 | B2 * | 9/2010 | Landrum | A63F 13/10 463/20 |
| 9,814,966 | B2 | 11/2017 | Gomez et al. | |
| 2007/0026918 | A1 | 2/2007 | Sheats, Jr. | |
| 2013/0300058 | A1 * | 11/2013 | Stellenberg | A63F 7/027 273/121 A |
| 2016/0317909 | A1 * | 11/2016 | Berman | A63F 7/027 |

* cited by examiner

*Primary Examiner* — Ronald Laneau
(74) *Attorney, Agent, or Firm* — Greenberg Traurig, LLP

(57) ABSTRACT

A modifiable pinball machine includes a processing device, a memory storing instructions executable by the processing device, a communications interface coupled to the processing device for receiving new music data from a source external to the pinball machine for storage in the memory, and a speaker coupled to the processing device for playing music retrieved from the memory. The new music data is provided with data useable by the instructions to cause the processing device to automatically retrieve from the memory the new music data in lieu of originally provisioned music data, for playing via use of the speaker, when the pinball machine is caused to operate in a predetermined operating state.

3 Claims, 2 Drawing Sheets

USER MODIFIABLE PINBALL MACHINE

BACKGROUND

Pinball machines of the commercial, e.g., revenue generating, and non-commercial, e.g., home entertainment, type are well known in the art. By way of example, U.S. Pat. Nos. 9,814,966, 5,338,031, 6,158,737, and U.S. Published Application No. 2007/0026918, each of which is incorporated herein by reference in its entirety, illustrate and describe pinball machines of the type having a cabinet which houses a playfield.

SUMMARY

The following describes a system and method for allowing a user to modify a pinball machine. In particular, the following describes a system and method for allowing a user to modify the music, e.g., songs, that will be played by the pinball machine. To this end, a modifiable pinball machine includes a processing device, a memory storing instructions executable by the processing device, a communications interface coupled to the processing device for receiving new music data from a source external to the pinball machine for storage in the memory, and one or more speakers coupled to the processing device for playing music data retrieved from the memory when the pinball machine is operating in a predetermined state of the pinball machine. The new music data is provided to the pinball machine with data useable by the instructions executable by the processing device to cause the processing device to automatically associate the new music data with the predetermined operating state of the pinball machine such that the processing device will retrieve from the memory, when the pinball machine is caused to operate in the predetermined state, the new music data, for playing via use of the one or more speakers, in lieu of original music data that was provisioned on the pinball machine and associated with the predetermined operating state of the pinball machine when the pinball machine was manufactured.

A better understanding of the objects, advantages, features, properties and relationships of the subject pinball machine will be obtained from the following detailed description and accompanying drawings which set forth illustrative embodiments which are indicative of the various ways in which the principles of the invention hereinafter claimed may be employed.

BRIEF DESCRIPTION OF THE DRAWINGS

For a better understanding of the subject system and method for allowing a user to modify a pinball machine reference may be had to the following drawings in which.

DETAILED DESCRIPTION

With reference to the figures, a system and method for modifying an amusement game device, in the exemplary form of a pinball machine 10, is now described. It is to be appreciated, however, that this exemplary form for the amusement game device 10 is not intended to be limiting. Rather, those of ordinary skill in the art will appreciated that the system and method described hereinafter can be utilized in any type of amusement game device of the commercial and non-commercial type.

Figure 1:
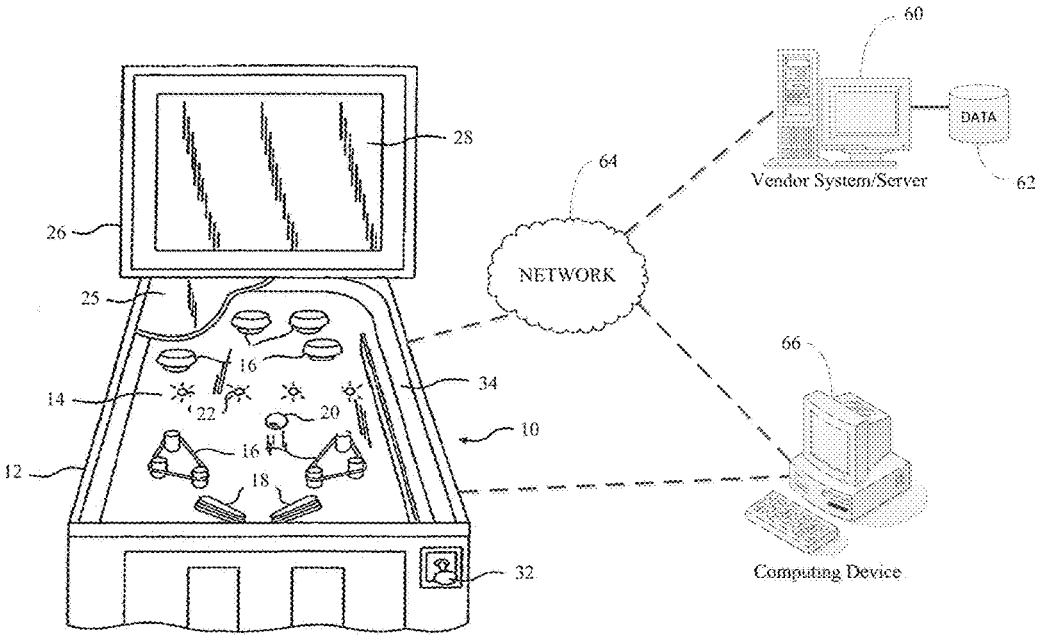
FIG. 1 illustrates an exemplary system for use in modifying a pinball machine.

In keeping with the example of an amusement game device of the pinball machine type, the pinball machine 10 illustrated in FIG. 1 includes a cabinet 12 which houses various apparatus used to define play of a game. Game play may be commenced in response to insertion of money—paper or coins referred to collectively as "coins"—into a coin accepting device, upon exercising of credits earned, by accepting payment from an account, e.g., via use of a swipe card reading device, a bar code reading device, a near field communications device, etc., and/or by otherwise making game play active. In a free play mode of operation, the game can be activated without the need for any money or money equivalent being provided to the machine. Upon activation of the game, game play is defined upon an inclined playfield 14 that supports a number of playfield accessories or devices. More particularly, game play is generally defined through the use of a pair of flippers 18 to propel a ball 20 relative to the playfield 14 and input devices/accessories associated with the playfield 14. The playfield 14 is usually inclined from the horizontal such that the ball 20 tends to eventually roll back down the playfield 14 in the direction of the flippers 18.

While not intended to be limiting, the playfield accessories or input devices 16 may include elements such as bumpers, ramps, and/or targets as well as one or more rollover switches 22. The playfield 14 may be covered by a transparent or glass sheet cover 25 to permit viewing of the playfield 14. In addition to the foregoing, the playfield 14 includes a plunger element 32 which shoots the ball up an alley 34 onto the playfield 14. The playfield 14 may also include lighting elements and/or other features as desired. Other player-activated input elements, typically in the form of push-buttons on the sides of the cabinet 12, are usually provided for controlling operation of the flippers 18. In some circumstances, particularly where the pinball machine 10 is to be utilized to communicate via a network with a vendor system as described below, the input elements may further include a microphone by which sound input/voice commands may be processed either locally and/or via a cloud based voice processing system. The pinball machine 10 may also include a backbox 26 which is mounted to overlay a top rear portion of the cabinet 12 and which contains a game display 28, such as a dot matrix display, CRT, LED, LCD, or plasma display, or the like. The backbox 26 may also support speakers, associated with the game sound system, for use in playing sounds and music, particularly songs, during game play. Within the backbox 26 may be located various ones of the electronic devices/circuits, e.g., processor 42, for controlling the operation of the playfield, the display, general illumination, and the sound system. Such electronic devices/circuits could also, in whole or in part, be carried within the game cabinet 12.

Figure 2:
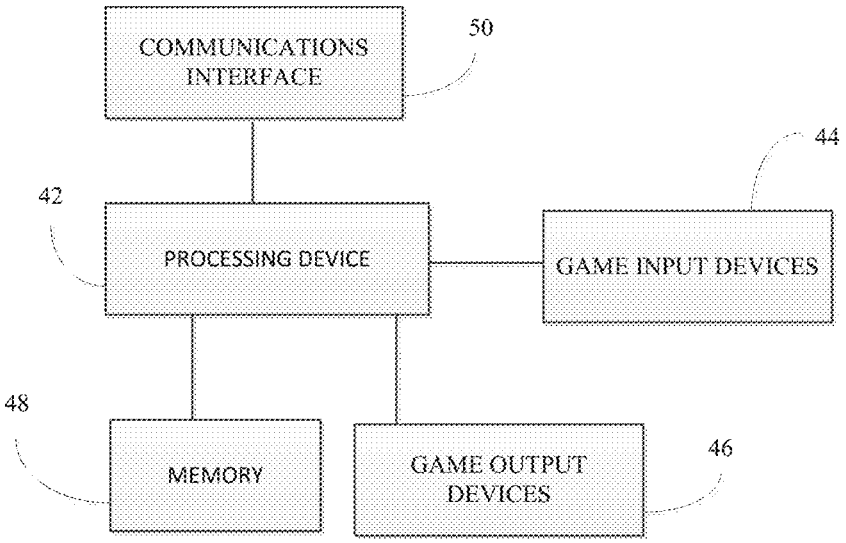
FIG. 2 illustrates, in block diagram form, exemplary components of the pinball machine of FIG. 1.

For controlling the various devices that form the amusement game 10, the amusement game 10 is provided with one or more processing devices (individually and collectively referred to hereinafter as a processing device 42) which processing device 42 is, in turn, coupled to game input devices 44, such as switches associated with the cabinet 12, playfield 14, etc., and game output devices 46, such as lights, flippers 18, display 28, game sound system including one or more speakers, etc. via one or more bus systems as shown in FIG. 2. A memory device 48, such as a RAM, ROM, or the like, stores instructions and data usable by the processing device 42 to control play of the game, the game output devices 46, and the game input devices 44 as necessary based upon signals provided by the game input devices 44. For example, the memory devices may include songs, stored in a digital format in whole or in part (e.g., like ringtones), that are to be played via the speaker(s) depending upon the operating state of the pinball machine 10, e.g., a current game play mode (such as during multi-ball, bonus mode, and the like), an attraction mode, etc. In this regard, the instructions executable by the processing device 42 may utilize a pointer to a specific memory location to access the digitally stored sounds that are to be played via the speakers depending upon the operating state of the pinball machine 10. It is to be understood that this illustrated embodiment is not intended to be limiting and that other manners for arranging the devices illustrated in FIG. 2 to provide for control of play of the pinball machine 10 can be utilized as needed.

As further shown in FIG. 2, the processing device 42 is further coupled to a communications interface 50. The communications interface 50 is intended to be utilized to at least receive modification data from a source external to the pinball machine 10 as described in greater detail below. By way of non-limiting example, the communications interface 50 may allow for wired and/or wireless communications to be received by and/or transmitted from the pinball machine 10 and, to this end, may include one or more of a WiFi transceiver, USB port and transceiver, Bluetooth transceiver, an Ethernet port and transceiver, etc. Via use of such a communications interface 50, the pinball machine 10 will be capable of communicating with a vendor system/server 60, having an associated data repository 62, via a network 64, such as the Internet, will be capable of communicating with a desktop, tablet, hand-held, or other computing device 66 (which itself may be adapted to communicate with the vendor system 60) directly and/or via a network, such as a local area network, and/or will be capable of receiving data from an external memory device, such as a USB memory stick or the like. Those of ordinary skill in the art will appreciate that these examples are not intended to be limiting and that other known means for transferring data and information to and/or from the pinball machine 10 may be used in keeping with the description that follows.

As noted, via the communications interface 50, the pinball machine 10 is intended to receive data from an external source of data. In the description that follows, such data is intended to be digital music. The received, new digital music is intended to be stored in the memory 48 in lieu of or in addition to original digital music that is provisioned on the pinball machine 10 when it is manufactured/sold. In this manner, the received, new digital music may be played via the speaker(s) depending upon the operating state of the pinball machine 10, e.g., a state of current game play, an attraction mode of the device, etc., in lieu of or in addition to the music/sounds that were originally provisioned on the pinball machine 10. To this end, any received digital music may be accompanied by data that allows the pinball machine 10 to automatically access the received digital music during operation of the pinball machine 10. Thus, the digital music may be accompanied by data that allows the processor of the pinball machine 10 to automatically store the received digital music in a location in memory that is predetermined to be accessed by the pinball machine 10 during operation of the pinball machine 10 when operating in a given state, may be accompanied by information that allows any pointers to memory locations or the like within the instructions executable by the processor to be automatically modified so that the processor of the pinball machine 10 will access the stored, received digital music as appropriate depending upon the operating state of the pinball machine 10, etc. In some instances, the pinball machine 10 data may also provide for a user interface to be displayed, for example via the display 28, whereby a user may be allowed to select and reprogram the pinball machine 10, for example via use of the flippers, via voice input, or via other input means, such that any desired one or more of the stored, received digital music is played during any desired one or more of the operating states of the pinball machine.

As further illustrated in FIG. 1, it is preferred that the new digital music data be stored, prior to retrieval, in a data repository 62 associated with a vendor system 60, such as Apple's ITunes brand online music portal. In this manner, a user may access the vendor system 60, for example via use of the computing device 66 and/or via the pinball machine 10 (provided the pinball machine 10 is provided with Web accessing functionality as needed) to browse, purchase, and download music. In a preferred embodiment, the user would only be able to access a portion of the vendor system 60 that is curated by the manufacturer of the pinball machine 10 where the music (and any accompanying data required for automatic install such that the music will fit into prescribed locations within the game) would be limited for use with specific pinball machines 10. For example, the digital music may be provided with a key or the like that allows the music to be downloaded, installed, and played only on a certain pinball machine 10. In this manner, a user would be prevented from playing the music on other, unauthorized devices. In some instances, the digital music may also be provided with a use limit key such that the music is incapable of being shared, installed, or played on more than one pinball machine 10. As noted above, such music may be received into the pinball machine 10 directly from the vendor system 60, via a wide area network 64, directly from the computing device 66, via a local area network, or indirectly from the computing device 66 via use of a data transfer device, such as a USB memory stick.

In a further example, geographic location information may be utilized to prevent a user from retrieving/downloading music that would otherwise be downloadable into and usable with a pinball machine 10. The geographic information may be provided to the vendor server 60 from a GPS device resident on an accessing device, e.g., computing device 66 or pinball machine 10, using WiFi positioning information, using positioning information obtained from an ISP, or the like. In addition, the geographic information may simply be obtained from billing information provided by the user. In this manner, the distribution of music to commercial pinball machines 10, for example, may be inhibited.

In a further example, when new music data is downloaded onto a pinball machine 10, the pinball machine 10 may be programmed to still use the original music when operating as a revenue generating device thus allowing the new music to be played only when the pinball machine 10 is operating as a free play device.

While specific embodiments of the subject system and method have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A pinball machine, comprising:

a processing device;

a memory storing instructions executable by the processing device;

a communications interface coupled to the processing device for receiving new music data from a source external to the pinball machine for storage in the memory; and one or more speakers coupled to the processing device for playing music data retrieved from the memory when the pinball machine is operating in a predetermined state of the pinball machine;

wherein the new music data is provided to the pinball machine with data useable by the instructions executable by the processing device to cause the processing device to automatically associate the new music data with the predetermined operating state of the pinball machine such that the processing device will retrieve from the memory, when the pinball machine is caused to operate in the predetermined state, the new music data, for playing via use of the one or more speakers, in lieu of original music data that was provisioned on the pinball machine and associated with the predetermined operating state of the pinball machine when the pinball machine was manufactured.

2. The pinball machine as recited in claim 1, wherein the data usable by the instructions executable by the processing device cause the processing device to automatically store the new music data in a location in the memory at which the original music data was stored when the pinball machine was manufactured.

3. The pinball machine as recited in claim 1, wherein the data usable by the instructions executable by the processing device cause the processing device to automatically modify the instructions so that a new location in the memory at which the new music data is stored will be accessed to thereby allow the new music data to be retrieved from memory when the pinball machine is caused to operate in the predetermined operating state of the pinball machine.

* * * * *